US009232330B2

(12) United States Patent
Fischer

(10) Patent No.: US 9,232,330 B2
(45) Date of Patent: Jan. 5, 2016

(54) METHOD AND APPARATUS FOR DETERMINING AN AMPLIFICATION FACTOR OF A HEARING AID DEVICE

(71) Applicant: SIVANTOS PTE. LTD., Singapore (SG)

(72) Inventor: Eghart Fischer, Schwabach (DE)

(73) Assignee: Sivantos Pte. Ltd., Singapore (SG)

( * ) Notice: Subject to any disclaimer, the term of this patent is extended or adjusted under 35 U.S.C. 154(b) by 318 days.

(21) Appl. No.: 13/970,039

(22) Filed: Aug. 19, 2013

(65) Prior Publication Data

US 2014/0050328 A1 Feb. 20, 2014

Related U.S. Application Data

(60) Provisional application No. 61/684,166, filed on Aug. 17, 2012.

(30) Foreign Application Priority Data

Jan. 23, 2013 (DE) ..... 10 2013 201 043

(51) Int. Cl.
*H04R 29/00* (2006.01)
*H04R 25/00* (2006.01)

(52) U.S. Cl.
CPC ..... *H04R 29/00* (2013.01); *H04R 25/407* (2013.01); *H04R 25/50* (2013.01); *H04R 25/70* (2013.01)

(58) Field of Classification Search
USPC ..... 381/60, 312
See application file for complete search history.

(56) References Cited

U.S. PATENT DOCUMENTS

| | | | | |
|---|---|---|---|---|
| 6,865,275 | B1 | 3/2005 | Roeck | |
| 7,010,133 | B2 | 3/2006 | Chalupper et al. | |
| 8,396,234 | B2 | 3/2013 | Derleth et al. | |
| 2005/0025325 | A1 * | 2/2005 | Fischer | 381/313 |
| 2012/0321092 | A1 | 12/2012 | Fischer | |

FOREIGN PATENT DOCUMENTS

| | | | |
|---|---|---|---|
| DE | 10308483 | A1 | 9/2004 |
| EP | 2235592 | B1 | 3/2012 |
| WO | 0033634 | A2 | 6/2000 |
| WO | 2011101042 | A1 | 8/2011 |

OTHER PUBLICATIONS

Naik, R et al.: "Implementation of Magnitude Estimation Algorithm for Hearing Aid", 2004 IEEE International Workshop on Biomedical Circuits & Systems BioCAS2004, 2004, pp. 13INV-5-13INV-8.

* cited by examiner

*Primary Examiner* — Duc Nguyen
*Assistant Examiner* — George Monikang
(74) *Attorney, Agent, or Firm* — Laurence Greenberg; Werner Stemer; Ralph Locher

(57) ABSTRACT

An amplification factor for a hearing aid device is generated by way of the following steps: forming a numerator, wherein the numerator includes a total with a first total component which is formed by means of multiplication of a strength of an approximately undisturbed signal with a first weighting and a second total component, which is formed by multiplication of a strength of a disturbed signal with a second weighting; forming a denominator, which includes the numerator as a first summand and a strength of an interference signal as a second summand. The amplification factor is finally determined by forming a quotient from the numerator divided by the denominator. An apparatus is configured to implement and carry out the novel method.

10 Claims, 4 Drawing Sheets

METHOD AND APPARATUS FOR DETERMINING AN AMPLIFICATION FACTOR OF A HEARING AID DEVICE

CROSS-REFERENCE TO RELATED APPLICATION

This application claims the priority, under 35 U.S.C. §119 (e), of provisional patent application No. 61/684,166, filed Aug. 17, 2012; and under 35 U.S.C. §119(a), of German patent application DE 10 2013 201 043.5, filed Jan. 23, 2013; the prior applications are herewith incorporated by reference in their entirety.

BACKGROUND OF THE INVENTION

Field of the Invention

The invention lies in the field of hearing devices and relates, more particularly, to a method for determining an amplification factor of a hearing aid device.

The method includes the following steps: determining a strength of an approximately undisturbed signal, determining a strength of an interference signal, determining a strength of a disturbed signal and generating the amplification factor. The strength of the approximately undisturbed signal and/or the strength of the interference signal and/or the strength of the disturbed signal may be for instance a moving average value of an instantaneous power, a moving average value of an effective value or a moving average value of a temporal curve of another amplitude value (for instance of an acoustic pressure, of a voltage or current signal) respectively. The moving average value may be generated for instance by means of sampling a voltage signal and a subsequent filtering by means of a low pass. The voltage signal may be a voltage signal, which is generated for instance by means of a half-wave rectifier or by means of a bridge rectifier circuit. The rectified voltage signal can also be supplied directly to a low pass filtering (without sampling).

The invention also relates to a corresponding apparatus.

Hearing devices are wearable hearing apparatuses that are used to support the hard of hearing. Different hearing device designs, such as behind-the-ear hearing devices (BTE), hearing devices with an external receiver (RIC: receiver in the canal) and in-the-ear hearing devices (ITE), for example also concha hearing devices or completely-in-canal hearing devices (ITE, CIC) are provided in order to accommodate the numerous individual requirements. The hearing devices listed by way of example are worn on the outer ear or in the auditory canal. However, bone conduction hearing aids, implantable or vibrotactile hearing aids are also commercially available, moreover. In this case damaged hearing is either mechanically or electrically stimulated.

In principle, hearing devices have as their fundamental components an input converter, an amplifier and an output converter. The input converter is usually a sound pick-up, for example a microphone and/or an electromagnetic receiver, for example an induction coil. The output converter is usually implemented as an electroacoustic converter, for example a miniature loudspeaker, or as an electromechanical converter, for example a bone conduction receiver. The amplifier is conventionally integrated in a signal processing unit. This basic construction is shown in FIG. 1 using the example of a behind-the-ear hearing device. One or more microphone(s) 2 for receiving the sound from the environment are fitted in a hearing device housing 1 for wearing behind the ear. A signal processing unit (SPU) 3, which is also integrated in the hearing device housing 1, processes the microphone signals and amplifies them. The output signal of the signal processing unit 3 is transmitted to a loudspeaker or receiver 4 which outputs an acoustic signal. The sound is optionally transmitted via a sound tube, which is fixed to an otoplastic in the auditory canal, to the eardrum of the wearer of the device. The energy supply to the hearing device, and in particular that of the signal processing unit 3, is effected by a battery (BAT) 5, which is likewise integrated in the hearing device housing 1.

Noise reduction algorithms, which are used in present day hearing aid devices, are based in most instances on the following equation for a Wiener filter. As a quotient, an amplification factor Q1 is calculated from a determined strength Xpi of an approximately undisturbed signal Xi divided by a total of the determined strength Xpi of the substantially undisturbed signal Xi and a determined strength SSpi of an interference signal SSi:

$$Q1=Xpi/(Xpi+SSpi).$$

In the case of a poor signal-to-noise ratio, the amplification factor is very small and can only be handled numerically with difficulty (for instance on account of quantization errors). A poor signal-to-noise ratio is understood here and below to mean a small ratio Xpi/Ypi between the determined Xpi of the approximately undisturbed signal Xi and the determined strength Ypi of the disturbed signal Yi.

For this reason, it is currently usual when using the above equation for a Wiener filter to restrict the amplification factor Q1 downwards by restricting an attenuation to 6 dB or to 10 dB.

BRIEF SUMMARY OF THE INVENTION

It is accordingly an object of the invention to provide a novel method and device for determining an amplification factor which overcome the above-mentioned disadvantages of the heretofore-known devices and methods of this general type and which provides for an alternative method, with which a reliable determination of an amplification factor can also be implemented in the context of poor signal-to-noise ratios.

With the foregoing and other objects in view there is provided, in accordance with the invention, a method of determining an amplification factor of a hearing aid device, the method which comprises:

determining a strength of an approximately undisturbed signal, determining a strength of an interference signal, determining a strength of a disturbed signal; and generating the amplification factor from the strength of the undisturbed signal, the strength of the interference signal, and the strength of the disturbed signal. The amplification factor is created by:

forming a numerator, the numerator including a total with a first total component formed by way of a multiplication of the strength of the approximately undisturbed signal with a first weighting and a second total component formed by way of a multiplication of the strength of the disturbed signal with a second weighting;

forming a denominator, the denominator including the numerator as a first summand and the strength of the interference signal as a second summand;

determining the amplification factor by forming a quotient from the numerator divided by the denominator.

It is then possible to set an amplification of the hearing aid device with the amplification factor and to amplify an input signal of the hearing aid device in accordance with the amplification factor. It will be understood, however, that this also encompasses an indirect setting of the amplification, that is, under the influence of an additional parameter.

In other words, the objects are achieved in accordance with the invention in that the generation of the amplification factor includes the following steps: determining a strength of an approximately undisturbed signal, determining a strength of an interference signal, determining a strength of a disturbed signal and generating the amplification factor. The generation of the amplification factor includes the following steps: forming a numerator, wherein the numerator includes a total with a first total component, which is formed by means of multiplication of the strength of the approximately undisturbed signal with a first weighting, and a second total component, which is formed by means of multiplication of the strength of the disturbed signal with a second weighting, forming a denominator, which, as a first summand, includes the numerator and as a second summand, includes the strength of the interference signal, and determining the amplification factor by means of forming a quotient from the numerator divided by the denominator.

With respect to the apparatus, the object is achieved in that the apparatus is configured so as to implement the method according to the invention.

The special form of the denominator of the quotient enables the range of values of the amplification factor (under boundary conditions, which are described below in the description of the figures) to be restricted implicitly and in a constantly differentiable manner to a range (which lies between 0.5 and 1 for instance) which can be handled numerically with ease. The term restrict in "a constantly differentiable manner" means that a not constantly differentiable dependency of the amplification factor on a strength of the disturbed signal and/or on a strength of the interference signal is avoided.

As a result of the method also including the step of determining a strength of an undisturbed signal and the formation of the numerator including adding the first total component and a second total component, which is formed by means of multiplication of the strength of the disturbed signal with a second weighting, an influence of the approximately undisturbed signal on a signal sink is increased if a good signal-to-noise ratio exists and the influence of the approximately undisturbed signal is reduced to the signal sink if a poor signal-to-noise ratio exists. The signal sink may for instance be the ear of a hearing device wearer, for which an acoustic signal is generated by taking the disturbed signal into account.

It may also be advantageous if the second weighting is determined by means of subtracting the first weighting from a constant value. An attenuation of one of the two signals is herewith adjusted to an attenuation of the other signal by means of an operation which can be implemented rapidly and efficiently with little effort.

One development provides that the first weighting can be set manually. Alternatively or in addition, the first weighting can also be set by means of an automatic controller or regulator. The automatic controller or regulator may set the first weighting for instance as a function of an evaluation of the approximately undisturbed signal and/or of the interference signal and/or of the disturbed signal. Alternatively or in addition, it is also conceivable that the automatic controller or regulator sets the first weighting as a function of an evaluation of the first signal defined below and/or of the second signal defined below and/or of the third signal defined below. Accordingly, the feature combinations described for an adjustability of the first weighting can alternatively or in addition also be provided for an adjustability of the second weighting.

An alternative or additional development provides that the approximately undisturbed signal is a band-restricted part of a first signal and/or that the interference signal is a band-restricted part of a second signal and/or that the disturbed signal is a band-restricted part of a third signal. Applying the method in sections as per the frequency explicitly allows such specific signal parts of the disturbed signal to be attenuated as have a poor signal-to-noise ratio, while those signal parts of the disturbed signal which have a good signal-to-noise ratio are not or only very slightly attenuated.

It may be expedient for use in the acoustic range if the interference signal is determined from a second signal, which is received from a second spatial direction, which deviates from a first spatial direction, from which a first signal is received, from which the approximately undisturbed signal is derived. Signals are herewith preferably supplied to the signal sink, said signals being received from the first spatial direction, wherein signals, which are received from the second direction, are suppressed.

In particular, it is preferred if the second spatial direction is set up opposite to the direction of the first spatial direction. An optimal suppression of an interference signal, which does not originate from the useful source, is herewith possible.

A preferred embodiment results if the disturbed signal is derived from a third signal, which is received with a directional selectivity, which is lower than a directional selectivity with which the second signal is received.

An alternative or additionally possible development consists in the disturbed signal being derived from a third signal, said third signal being received with a directional selectivity, which is lower than a directional selectivity with which the first signal is received. Each of the two afore-cited measures represents a contribution in that the signal sinks can even be supplied with unattenuated signals or signals with low attenuation, which originate from directions which differ from the first direction.

It is particularly preferable if the first, second and/or third signal is an acoustic signal, which is detected by means of a hearing aid device. This enables the method to be used in order to improve a use of a hearing aid device.

Other features which are considered as characteristic for the invention are set forth in the appended claims.

Although the invention is illustrated and described herein as embodied in a method and apparatus for determining an amplification factor of a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
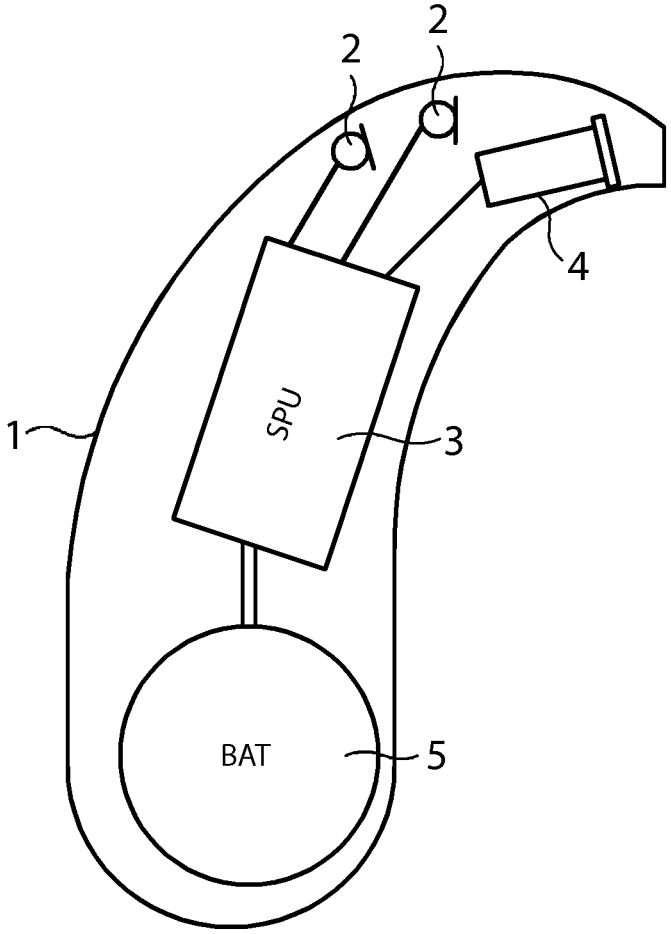
FIG 1 PRIOR ART
FIG. 1 shows a hearing aid device according to the prior art in a highly simplified block diagram.

Referring now to the figures of the drawing in detail and first, particularly, to FIG. 1 thereof, there is shown a very simplified block diagram of the structure of a hearing aid device according to the prior art. In principle hearing devices have as their fundamental components one or more input converters, an amplifier and an output converter. The input converter is usually a sound pick-up, for example a microphone and/or an electromagnetic receiver, for example an induction coil. The output converter is usually implemented as an electroacoustic converter, for example a miniature loudspeaker and/or receiver, or as an electromechanical converter, for example a bone conduction receiver. The amplifier is conventionally integrated in a signal processing unit.

The exemplary embodiment illustrated in FIG. 1 is a behind-the-ear (BTE) hearing device. Two microphones 2, 2 for receiving the sound from the environment are fitted in a hearing device housing 1 for wearing behind the ear. A signal processing unit (SPU) 3, which is also integrated in the hearing device housing 1, processes the microphone signals and amplifies them. The output signal of the signal processing unit 3 is transmitted to a loudspeaker or receiver 4 which outputs an acoustic signal. The sound is optionally transmitted via a sound tube, which is fixed to an otoplastic in the auditory canal, to the eardrum of the wearer of the device. The energy necessary to operate the hearing device, and in particular for running the signal processing unit 3 is supplied by way of a battery (BAT) 5, which is likewise integrated in the hearing device housing 1.

Figure 2:
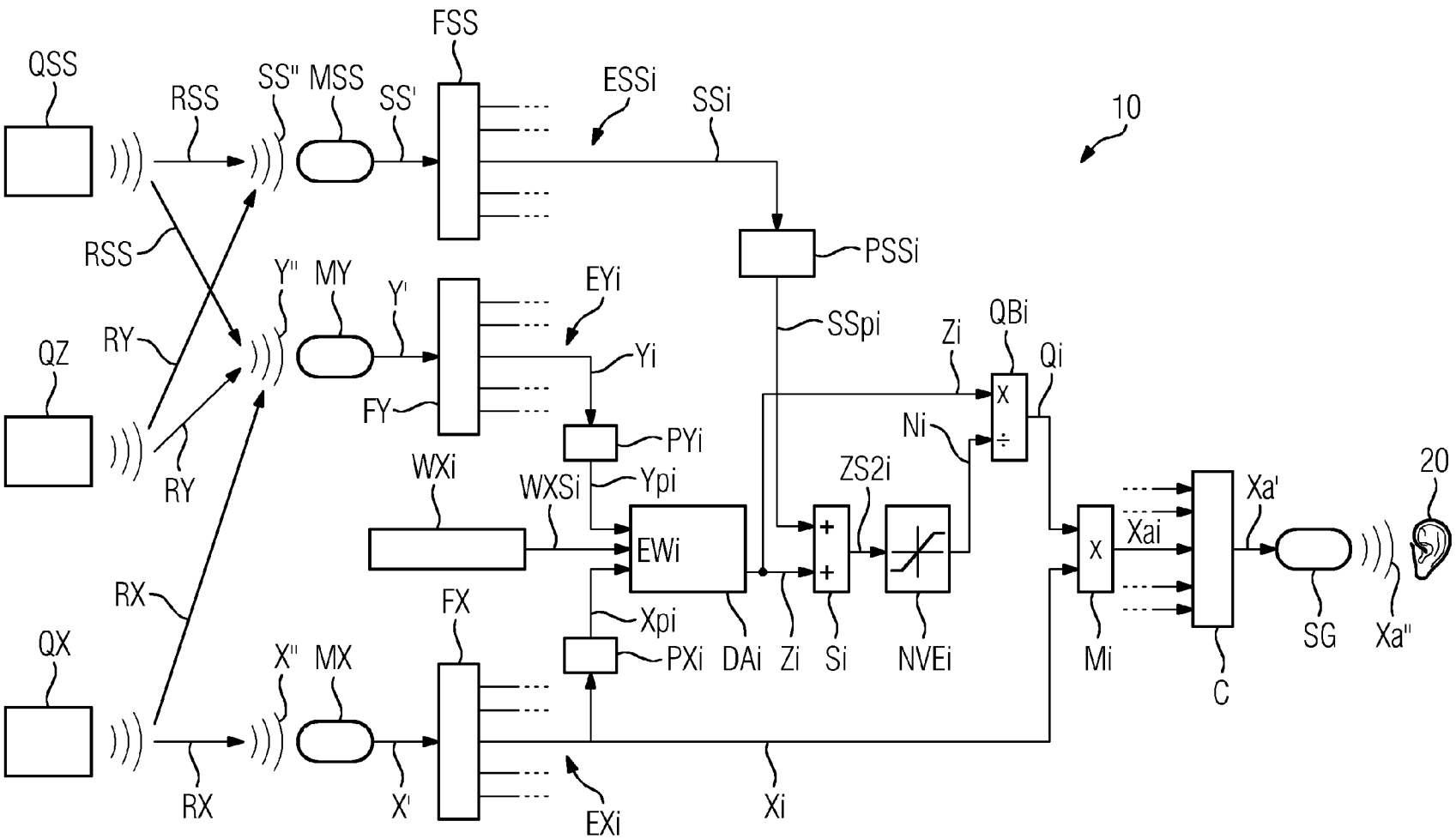
FIG. 2 shows a schematic block diagram of an apparatus for determining an amplification factor of a hearing aid device.

The apparatus 10 shown in FIG. 2 for determining an amplification factor of a hearing aid device has three inputs EYi, ESSi, EXi for a microphone signal Y', SS', X' in each instance. The first input EXi is provided for a bandpass-restricted microphone signal Xi, which is received from a direction RX, in which an acoustic useful source QX is located, the acoustic signal X" of which is to be fed in prepared form to an ear 20 of a hearing device wearer. The second input ESSi is provided for a bandpass-restricted microphone signal SS1, which is received from a direction RSS, in which an acoustic interference source QSS is located, the acoustic signal SS" of which is to be regarded as a pure interference signal. The third input EYi is provided for a bandpass-restricted microphone signal Yi, which, with an omnidirectional characteristic, in other words is received by one or a number of acoustic sources QZ, QSS, which are found in one or a number of undetermined directions, which do not correspond to the direction RX.

For the sake of clarity, different microphones MX, MY, MSS for generating the microphone signals Y', Y' and SS' are plotted in FIG. 2. Nevertheless, all three microphone signals Y', Y' and SS' are typically generated by means of a single double microphone, the directional characteristic of which can be varied electronically. The peaks of the directional arrows RX, RY and RSS of the different sound sources QSS, QX, QZ thus typically end at the same location.

The double microphone preferably includes a first and a second microphone, which each comprises an omnidirectional receive characteristic. The two microphones are typically arranged one behind the other at a distance of 6 to 10 mm in direction RX. In terms of terminal behavior, the double microphone obtains a kidney receive characteristic by means of a run-time delay of the electrical output signal of one of the two microphones, which is adjusted to an acoustic run-time difference in the RX direction, and a subtraction of the run-time-delayed output signal from the output signal of the other microphone (or by means of a reverse subtraction).

The units FX, FY und FSS are filter banks, which are prepared to convert the respective microphone signal X', Y' and/or SS' into a number of band-restricted input signals Xi, Yi, SSi, which are adjacent in the frequency range. The letter i in the reference characters is a reminder that there are multiple circuit parts between the filter banks FSS, FX, FY and the frequency multiplexer C.

The signal strength determiners PXi, PYi und PSSi are prepared to this end to determine a signal strength Xpi, Ypi, SSpi from the band-restricted input signals Xi, Yi, SSi in each instance.

Alternatively, at least one of the units FX, FY, FSS or each of the units FX, FY, FSS is embodied to this end to convert the microphone signal X', Y', SS' supplied thereto in the time domain into an amplitude distribution density function for instance across the frequency by means of a Fourier transformer respectively and to scan the signal strength thereof at (preferably equidistant) frequency intervals.

The apparatus 10 includes a differential adder DAi, which adds the two signal strengths Xpi and Ypi and provides the added signal strength value as a first intermediate signal ZI (numerator Zi). Before adding the signal strengths of the two signal strengths Xpi, Ypi, the differential adder DAi applies a first weighting WXi to the signal strength XPi of the approximately undisturbed signal Ix and a second weighting WYi to the signal strength Ypi of the disturbed signal Yi. The differential adder DAi has an input EWi for a weighting signal WXSi, the value WXi of which can be set manually and/or the value WXi of which is set by means of an automatic controller or regulator (not shown in the Figures). The first weighting WXi corresponds to the value of the weighting signal WXSi. The differential adder DAi determines the second weighting WYi=1−WXi by means of a subtraction of the first weighting WXI from 1.

The apparatus 10 includes a summing unit SI, which adds the first intermediate signal Zi (numerator Zi) and the signal strength of the interference signal SSi. The result is a second intermediate signal ZS2i. A zero point prevention unit NVEi converts the second intermediate signal ZS2i into a zero point-free third intermediate signal Ni (denominator). A subsequent division by zero is thus prevented. Furthermore, the apparatus 10 includes a quotient former QBi, which generates an amplification factor Qi (Quotient Qi) by dividing the first intermediate signal (numerator Zi) by the third intermediate signal Ni (denominator Ni). Furthermore, the apparatus 10 includes a multiplier Mi, in order to apply the amplification factor Qi to the approximately undisturbed signal Zi and to form a frequency band-specific output signal Xai. Furthermore, the apparatus 10 includes a frequency multiplexer C, in order to combine the frequency band-specific output signals Xai of the various frequency bands to form a synthesized output signal Xa'. The synthesized output signal Xa' is supplied to a transducer SG which converts the synthesized output signal Xa' into a corresponding sound signal Xa", which is supplied to an ear 20 of a hearing aid device wearer.

Figure 3:
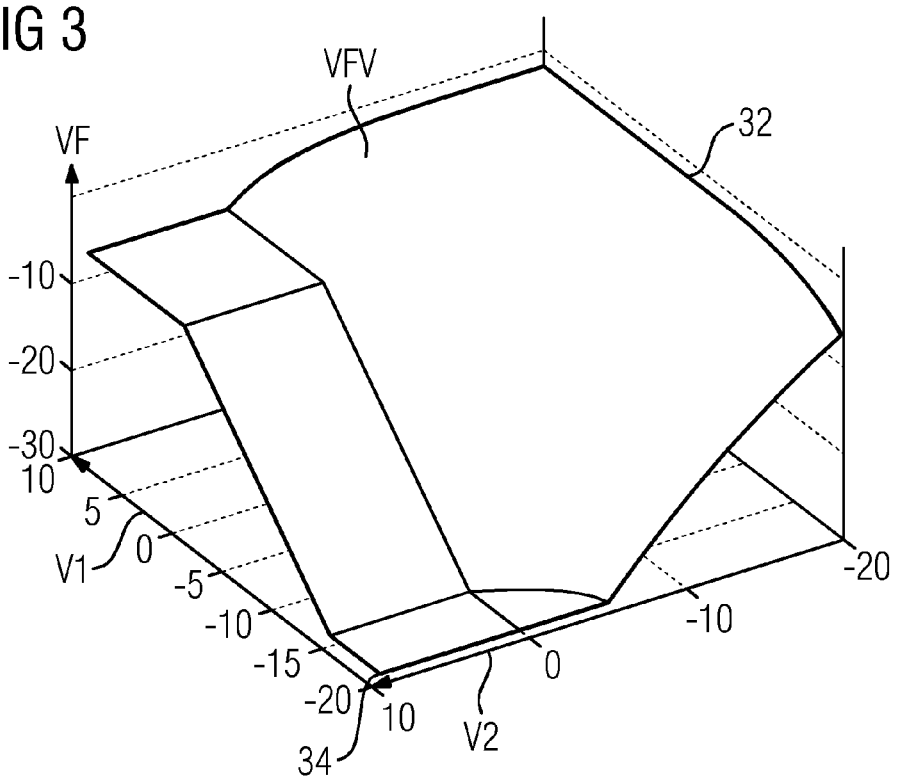
FIG. 3 shows a three-dimensional diagram showing the dependency of the amplification factor on a first level difference between a level of the approximately undisturbed signal and a level of the disturbed signal and a second level difference between a level of the interference signal and a level of the disturbed signal in the event that the disturbed signal is not taken into consideration.
Figure 4:
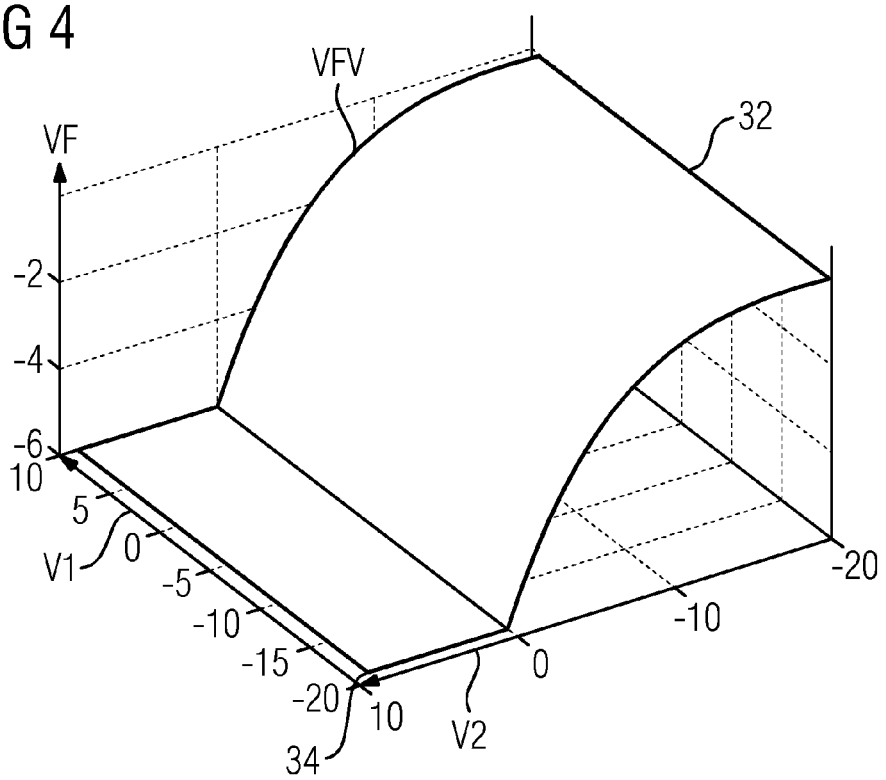
FIG. 4 shows a three-dimensional diagram showing the dependency of the amplification factor on a first level difference between a level of the approximately undisturbed signal and a level of the disturbed signal and a second level difference between a level of the interference signal to a level of the disturbed signal in the event that the approximately undisturbed signal is not taken into consideration.
Figure 5:
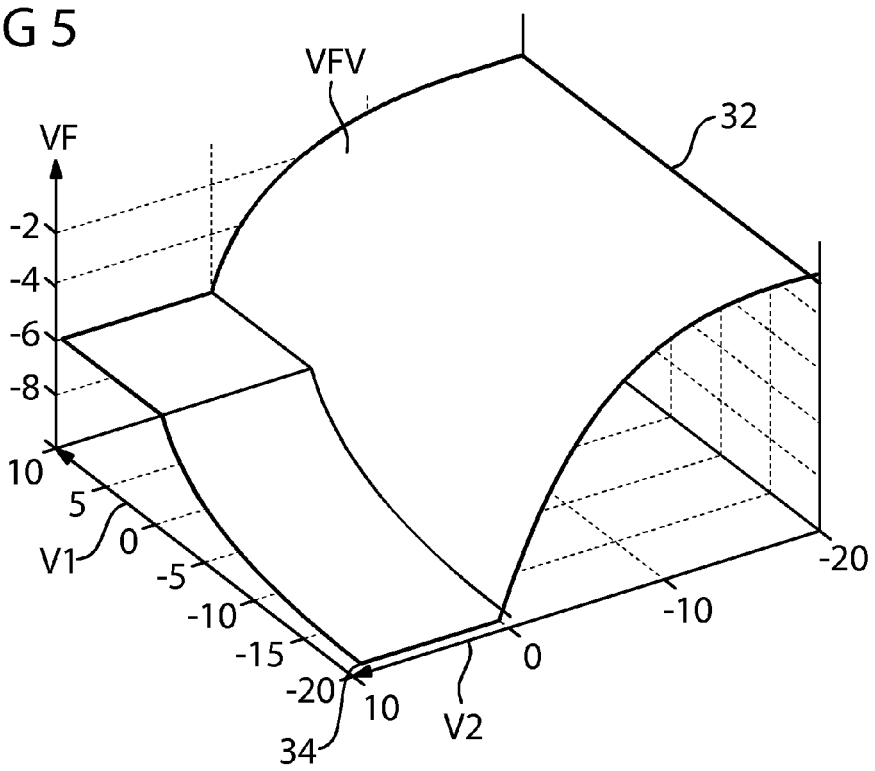
FIG. 5 shows a three-dimensional diagram showing the dependency of the amplification factor on a first level difference between a level of the approximately undisturbed signal and a level of the disturbed signal and a second level difference between a level of the interference signal and a level of the disturbed signal in the event that the approximately undisturbed and the disturbed signal are each taken into consideration one half each.

FIGS. 3, 4 and 5 show in dB (in other words in a triple logarithmic representation) for different values of the weighting signal WXi how an amplification factor Qi depends on a first level difference V1 between a signal strength Xpi of the approximately undisturbed signal Xi and a signal strength Ypi of the disturbed signal Yi and on a second level difference V2 between a signal strength SSpi of the interference signal SSi and the signal strength Ypi of the disturbed signal Yi.

In FIG. 3 the first weighting WXi is set such that the signal strength Ypi of the disturbed signal Yi is not incorporated in the amplification factor Qi. In FIG. 4 the first weighting WXi is set such that approximately the signal strength Ypi of the undisturbed signal Xi is not incorporated in the amplification factor Qi. In FIG. 5, the first weighting WXi is set such that the signal strength Xpi, Ypi of the approximately undisturbed signal Xi and/or of the disturbed signal Yi is incorporated one half each in the amplification factor Qi.

As the right upper edge 32 of the amplification factor curve QiV of all three diagrams shows, the amplification factor Qi is in any case high irrespective of the weighting WXi if the second level difference V2 is low.

As the lower corner 34 of the amplification factor curve QiV of all three diagrams shows, the amplification factor Qi is in any case high irrespective of the weighting WXi, in which the first level difference V1 is low and at the same time the second level difference V2 is high.

The weighting WXi therefore only then has a significant effect on the amplification factor Qi, if the second level difference V2 is not small. In this case the effect on the amplification factor Qi is all the greater, the greater the first level difference V1.

Figure 6:
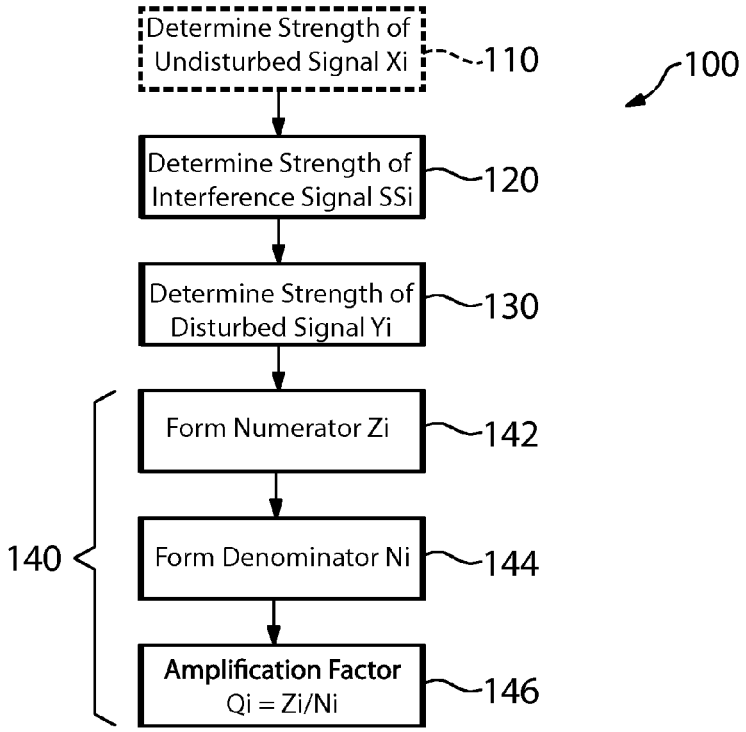
FIG. 6 shows a schematic flow chart of a novel method for determining an amplification factor of a hearing aid device.

The method 100 shown in FIG. 6 for determining an amplification factor of a hearing aid device includes the following steps: In a first step 110, a signal strength Xpi of an approximately undisturbed signal Xi is determined. In a second step 120, a signal strength SSpi of an interference signal SSi is determined. In a third step 130, a signal strength Ypi of a disturbed signal Yi is determined. In a fourth step 140, an amplification factor Qi is generated. The generation 140 of the amplification factor Qi includes the following sub steps. In a first sub step 142, a numerator Zi is formed. The numerator Zi includes a total with a first total component, which is formed by means of multiplication of the signal strength Xpi of the approximately undisturbed signal Xi with a first weighting WXi, and a second total component, which is formed by means of multiplication of the signal strength Ypi of the undisturbed signal Yi with a second weighting WYi. In a second sub step 144, a denominator Ni is formed, which includes the numerator Zi as a first summand and the signal strength SSpi of the interference signal SSi as a second summand. In a third sub step 146, an amplification factor Qi is determined by means of forming a quotient Qi from the numerator Zi divided by the denominator Ni.

It is particularly preferable if the second weighting WYi is determined by subtracting the first weighting WXi from a constant value.

It is also expedient if the first weighting WXi can be set manually and/or if the first weighting WXi can be set by means of an automatic controller or regulator and/or if the second weighting WYi can be set manually and/or if the second weighting WYi can be set by means of an automatic controller or regulator.

It may be advantageous in acoustic applications if the approximately undisturbed signal Xi is a band-restricted part of a first microphone signal Xi and/or if the interference signal SSi is a band-restricted part of a second microphone signal SS' and/or if the disturbed signal Yi is a band-restricted part of a third microphone signal Y'.

For direction-specific suppression of interference signals, it is expedient if the interference signal SSi is determined from a second signal SS, which is received from a second spatial direction RSS which deviates from a first spatial direction RX, from which a first signal X' is received, from which the approximately undisturbed signal Xi is derived.

The first spatial direction RX is preferably opposite to the second spatial direction RSS.

One development provides that the disturbed signal Yi is derived from a third signal Y' which is received with a directional selectivity which is lower than a directional selectivity with which the second signal SS' is received.

One alternative or additionally possible development provides that the disturbed signal Yi is derived from a third signal Y, which is received with a directional selectivity which is lower than a directional selectivity with which the first signal X' is received.

In hearing aid device applications the first X', second SS' and/or third signal Y' is typically an acoustic signal which is detected by means of a hearing aid device 10.

It is proposed in accordance with the invention to determine the amplification factor Qi in accordance with the following formula (1):

$$Qi=(Xpi\cdot WXi+Ypi\cdot WYi)/(Xpi\cdot WXi+Ypi\cdot WYi+SSpi). \quad (1)$$

For Xpi·WXi+Ypi·WYi>0 this is equivalent to the following formula (2):

$$Qi=1/(1+SSpi/(Xpi\cdot WXi+Ypi\cdot WYi)). \quad (2)$$

Assuming that Ypi=SSpi+Xpi and WXi+WYi=1 therefore produces the following formula (3):

$$Qi=1/(1+SSpi/(Xpi+SSpi\cdot WYi)). \quad (3)$$

If a ratio (signal-to-noise ratio) of the strength Xpi of the undisturbed signal to the strength SSpi of the interference signal is defined with v:=Xpi/SSpi, this results in formula (4):

$$Qi=1/(1+1/(v+WYi)). \quad (4)$$

In a first extreme case, the interference signal has a negligible strength so that v is a very high value and the amplification factor Qi is then calculated approximately as follows (irrespective of the ratio between WXi and WYi):

$$Qi=1.$$

In a second extreme case, the strength SSpi of the disturbed signal is approximately just as large as the strength Ypi of the interference signal, so that the strength Xpi of the undisturbed signal is then negligible, v amounts to approximately zero and the amplification factor Qi is then calculated approximately as follows: Qi=1/(1+1/WYi). If the second weighting WYi lies between 0 and 1, an amplification factor Qi which lies between 0 and 0.5 thus results depending on the size of the second weighting WYi for the second extreme case.

In a case lying therebetween, the strength SSpi of the interference signal only insignificantly differs from the strength Xpi of the undisturbed signal so that v=1 and the amplification factor Qi is calculated approximately as follows:

Qi=1/(1+1/(1+WYi)). An amplification factor Qi which lies between ½ and ⅔ thus results if the second weighting WYi lies between 0 and 1, depending on the size of the second weighting WYi for the case lying therebetween.

WYi is typically set to a value which is greater than 0.1, preferably greater than 0.2, in particular preferably greater than 0.4. Alternatively or in addition, WYi is set to a value which is less than 0.9, preferably greater than 0.8, particularly preferably smaller than 0.6.

In a typical case, v=0.8 approximately and the amplification factor Qi is then calculated approximately as follows: Qi=1/(1+1/(0.8+WYi)). An attenuation by 6 dB=0.5 thus results if WYi=0.2. If WYi=0.8 the attenuation then amounts to approximately 0.6. If WYi is smaller than 0.2, attenuation values result in this case which are smaller than 0.5.

Formula (4) then calculates how large (v+WYi) must be so that the amplification factor Qi does not reach a specific minimum value Qmin (Qi>=Qmin). The following formula (5):

$$v+WYi>=Q\min/(1-Q\min) \quad (5)$$

results from Qmin<=1/(1+1/(v+WYi))for positive values of(v+WYi).

If the amplification factor Qi is to amount to at least 0.5 (the attenuation factor is at most 6 dB), v+WYi amounts to at least 1 (WYi>=1−v). The following must then apply:

$$WYi>=1-Xpi/SSpi.$$

If WYi=1−Wxi, then WXi<=v;

i.e., WXi<=Xpi/SSpi then also applies.

It may therefore be expedient to develop the embodiments of the description defined in the claims and/or predescribed in the description by restricting or setting the first weighting WXi by means of an automatic controller or regulator to the value v=Xpi/SSpi and/or restricting or setting the second weighting WYi downwards to the value 1−Xpi/SSpi)=(1−v) by means of an automatic controller or a closed-loop controller.

The invention claimed is:

1. A method of determining an amplification factor of a hearing aid device, the method which comprises:

determining a strength of an approximately undisturbed signal;

determining a strength of an interference signal;

determining a strength of a disturbed signal;

generating the amplification factor from the strength of the undisturbed signal, the strength of the interference signal, and the strength of the disturbed signal, by:

forming a numerator, the numerator including a total with a first total component formed by way of a multiplication of the strength of the approximately undisturbed signal with a first weighting and a second total component formed by way of a multiplication of the strength of the disturbed signal with a second weighting;

forming a denominator, the denominator including the numerator as a first summand and the strength of the interference signal as a second summand;

determining the amplification factor by forming a quotient from the numerator divided by the denominator; and setting an amplification of the hearing aid device with the amplification factor and amplifying an input signal of the hearing aid device in accordance with the amplification factor.

2. The method according to claim 1, which comprises determining the second weighting by subtracting the first weighting from a constant value.

3. The method according to claim 1, which comprises selectively performing one or more of the following:

manually setting the first weighting;

setting the first weighting by way of an automatic controller or a closed-loop controller;

manually setting the second weighting; and/or setting the second weighting by way of an automatic controller or a closed-loop controller.

4. The method according to claim 1, wherein at least one of the following is true:

the approximately undisturbed signal is a band-restricted part of a first signal, the interference signal is a band-restricted part of a second signal, and/or the disturbed signal is a band-restricted part of a third signal.

5. The method according to claim 1, which comprises deriving the approximately undisturbed signal from a first signal received from a first spatial direction, and determining the interference signal from a second signal received from a second spatial direction that deviates from the first spatial direction from which the first signal is received.

6. The method according to claim 5, wherein the second spatial direction is opposite to the first spatial direction.

7. The method according to claim 5, which comprises deriving the disturbed signal from a third signal received with a directional selectivity that is less than a directional selectivity with which the second signal is received.

8. The method according to claim 5, which comprises deriving the disturbed signal from a third signal received with a directional selectivity that is less than a directional selectivity with which the first signal is received.

9. The method according to claim 5, wherein at least one of the first signal, the second signal, or the third signal is an acoustic signal acquired by way of a hearing aid device.

10. An apparatus, comprising a processing device configured to implement the method according to claim 1.

* * * * *